US006079761A

United States Patent [19]

Sadeck

[11] Patent Number: 6,079,761

[45] Date of Patent: Jun. 27, 2000

[54] RETRACTABLE GRAPPLING HOOK

[75] Inventor: James E. Sadeck, East Freetown, Mass.

[73] Assignee: The United States of America as represented by the Secretary of the Army, Washington, D.C.

[21] Appl. No.: 09/131,786

[22] Filed: Aug. 10, 1998

[51] Int. Cl.[7] ..... B66C 1/34

[52] U.S. Cl. ..... 294/82.1; 114/302; 114/307; 294/66.1; 294/97

[58] Field of Search ..... 294/66.1, 82.1, 294/82.17, 82.24, 82.31, 82.32, 85, 95, 97, 106, 115, 116; 15/104.31, 104.32; 114/297–299, 302–304, 307, 310

[56] References Cited

U.S. PATENT DOCUMENTS

| | | | |
|---|---|---|---|
| D. 297,321 | 8/1988 | Merrie | D12/215 |
| 1,031,903 | 7/1912 | Anderson | 294/66.1 |
| 1,295,076 | 2/1919 | Sherman et al. | 294/66.1 X |
| 2,887,980 | 5/1959 | Madden | 114/298 |
| 2,940,411 | 6/1960 | Bartels et al. | 114/299 |
| 3,021,812 | 2/1962 | Swails | 114/298 |
| 3,485,199 | 12/1969 | Schuman | 114/298 |
| 3,593,682 | 7/1971 | Zitzow | 114/298 |
| 4,038,934 | 8/1977 | Thomson | 114/298 |
| 4,108,484 | 8/1978 | Malroit | 294/66.1 |
| 4,114,554 | 9/1978 | Miller | 114/298 |
| 4,125,082 | 11/1978 | Wolfrey et al. | 114/298 |
| 4,133,569 | 1/1979 | Pavack et al. | 294/66.1 X |
| 4,210,092 | 7/1980 | Battersby | 114/299 |
| 4,369,727 | 1/1983 | Fasco | 114/297 |
| 4,379,580 | 4/1983 | Staempfli | 294/66.1 X |
| 4,385,584 | 5/1983 | Simpson, III | 114/306 |
| 4,577,582 | 3/1986 | Hedden | 114/298 |
| 4,579,077 | 4/1986 | Soules | 114/301 |
| 4,596,202 | 6/1986 | Brewster | 114/303 |
| 4,700,420 | 10/1987 | Belanger | 7/114 |
| 4,951,593 | 8/1990 | Brown et al. | 114/297 |
| 5,095,842 | 3/1992 | Soules | 114/299 |
| 5,404,831 | 4/1995 | Miller | 114/306 |

FOREIGN PATENT DOCUMENTS

| | | | |
|---|---|---|---|
| 79141 | 9/1931 | Sweden | 114/298 |
| 4167 | 4/1877 | United Kingdom | 294/66.1 |

*Primary Examiner*—Johnny D. Cherry
*Attorney, Agent, or Firm*—Vincent J. Ranucci

[57] ABSTRACT

A retractable grappling hook generally comprising a shaft having a longitudinal extending axis and a plurality of hooks pivotally attached to the shaft. Each hook has a longitudinally extending axis and is pivotal to a retracted position such that the axis of each hook is substantially parallel to the axis of the shaft and to an extended position such that the axis of each hook is angulated with respect to the axis of the shaft. The retractable grappling hook further comprises a hook control system on the shaft for configuring and locking the hooks in either the extended or retracted positions, and an attachment member attached to the shaft for attaching the grappling hook to other devices.

16 Claims, 4 Drawing Sheets

RETRACTABLE GRAPPLING HOOK

The invention described herein may be manufactured, used and licensed by or for the Government for Governmental purposes without the payment to us of any royalty thereon.

BACKGROUND OF THE INVENTION

1. Field of the Invention

The present invention generally relates to a grappling hook.

2. Problem to be Solved

Grappling hooks are used in many settings, e.g. maritime, recreational, military, industrial, etc. Conventional grappling hooks are bulky and inconvenient to transport and store. Furthermore, one grappling hook configuration suited for one particular application may not be suited for another application. For example, a grappling hook may be suited for mountain climbing, but not suited for functioning as an anchor for a boat anchor. What is needed is a new and improved grappling hook that is reliable, compact and yet versatile for many applications.

It is therefore an object of the present invention to provide a new and improved grappling hook that is relatively light in weight.

It is another object of the present invention to provide new and improved grappling hook that is compact and which can be easily transported and stored.

It is another object of the present invention to provide new and improved grappling hook that can be manufactured at reasonable costs.

Other objects and advantages of the present invention will be apparent to one of ordinary skill in the art in light of the ensuing description of the present invention.

SUMMARY OF THE INVENTION

The present invention is directed to a retractable grappling hook comprising a shaft having a longitudinal extending axis a plurality of hooks pivotally attached to the shaft. Each hook has a longitudinally extending axis and is pivotal to a retracted position such that the axis of each hook is substantially parallel to the axis of the shaft and to an extended position such that the axis of each hook is angulated with respect to the axis of the shaft. The retractable grappling hook further comprises a hook control system on the shaft for configuring and locking the hooks in either the extended or retracted positions, and an attachment member attached to the shaft for attaching the grappling hook to other devices.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

In describing the preferred embodiments of the present invention, reference will be made herein to FIGS. 1–9 of the drawings in which like numerals refer to like features of the invention.

Figure 1:
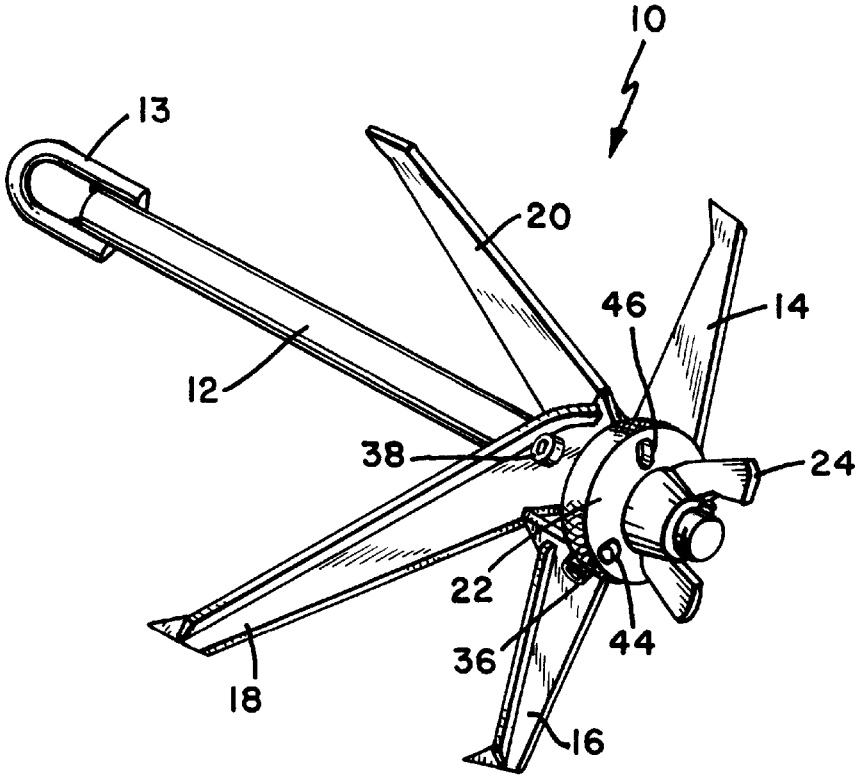
FIG. 1 is a perspective view of the retractable grappling hook of the present invention.
Figure 7A:
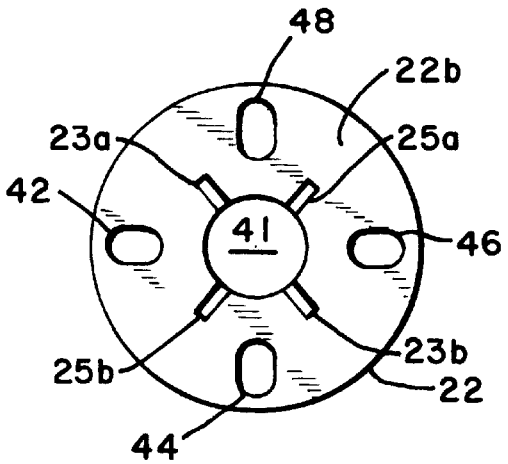
FIG. 7A is bottom view of the hook control member depicted in FIG. 7.
Figure 7:
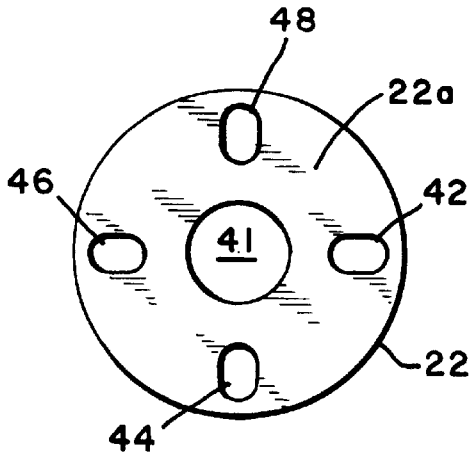
FIG. 7 is a top plan view of a hook control member depicted in FIG. 2.
Figure 2:
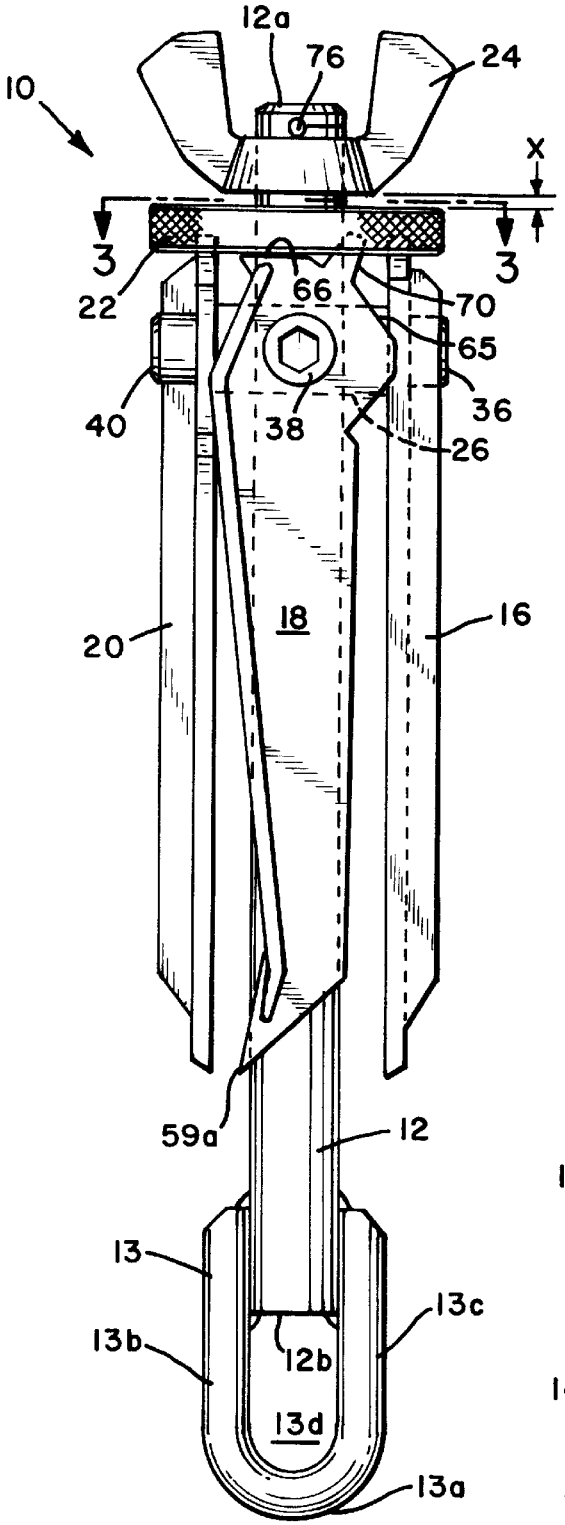
FIG. 2 is an elevational view of the retractable grappling hook of FIG. 1 in a retracted position.
Figure 3:
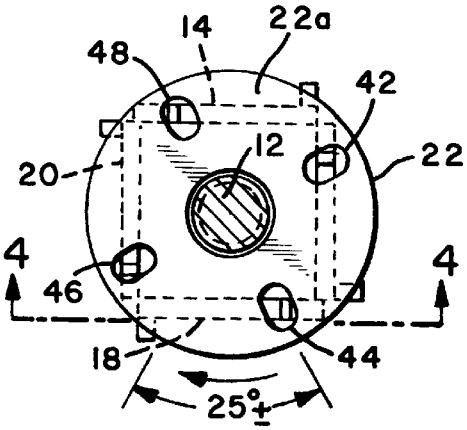
FIG. 3 is a view taken along line 3—3 of FIG. 2.
Figure 9:
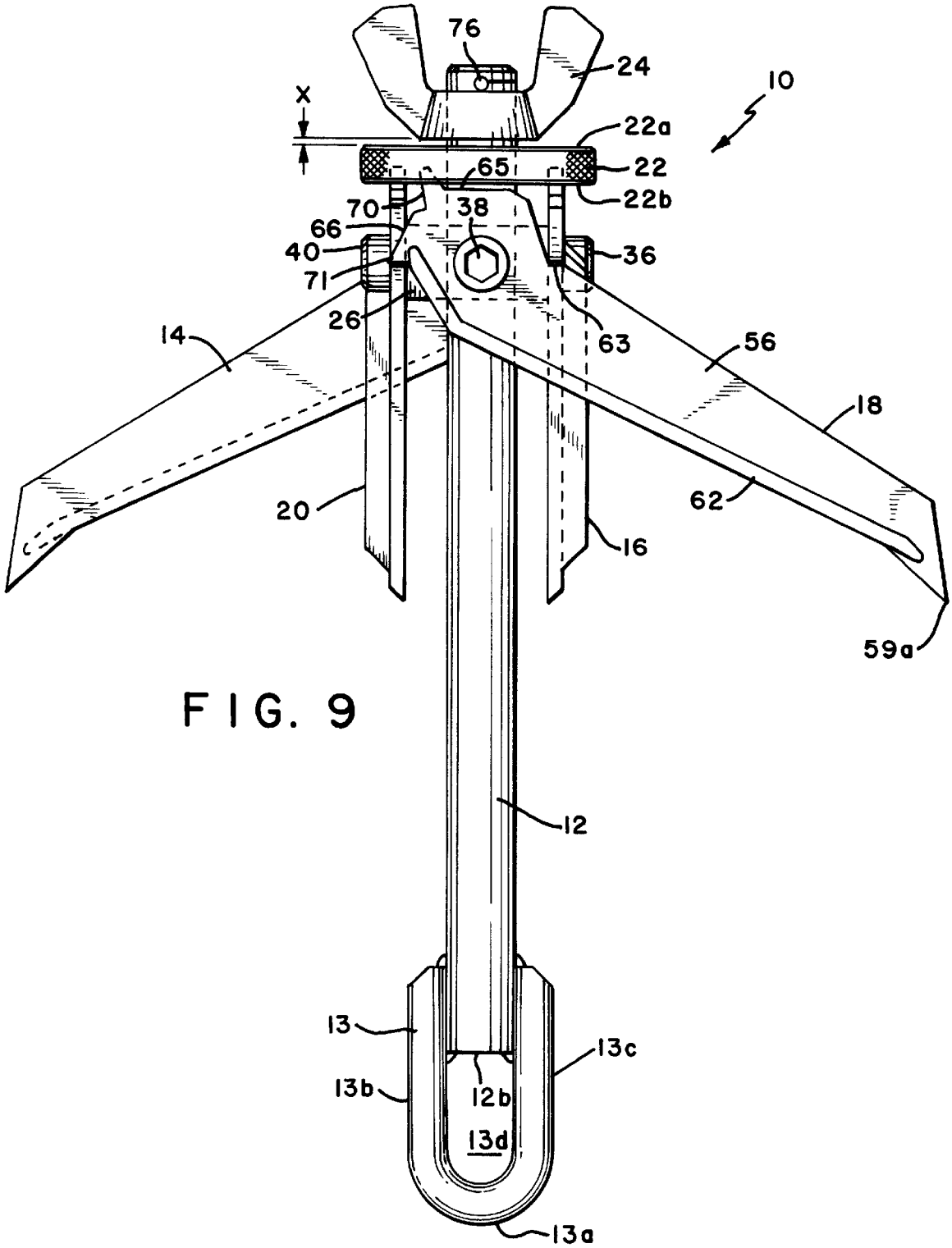
FIG. 9 is an elevational view of the grappling hook of FIG. 1 in an extended position.

Referring to FIGS. 1, 2 and 9, retractable grappling hook 10 of the present invention generally comprises shaft 12, hooks 14, 16, 18 and 20, hook control member 22, and lock member 24.

In the ensuing discussion, the terms "clockwise" and "counter-clockwise" are used to describe the workings of the present invention. It is to be understood that these terms correlate to the vertical orientation of grappling hook 10 as shown in FIGS. 2 and 9.

Referring to FIG. 2, grappling hook 10 further includes attachment member 13 rigidly attached to shaft 12. Attachment member 13 is substantially U-shaped having a closed end 13*a* and a pair of extending wall members 13*b*, 13*c* which define an interior region 13*d*. End 12*b* of the shaft 12 is disposed within a portion of the interior region 13*d*. The remaining portion of interior region 13*d* defines an opening that can be used to attach grappling hook 10 to other devices such as ropes, wires, rescue lines, chains, cables, etc.

Referring to FIGS. 2, 4, 4A, 6 and 6A, each hook 14, 16, 18 and 20 is pivotally attached to shaft 12. Hook support member 26 is attached to shaft 12 (see FIG. 6). Member 26 has threaded inlets 28, 30, 32 and 34 (see FIG. 6A) that are configured to threadedly receive screws 36, 38 and 40 (the fourth screw not shown) that secure hooks 14, 16, 18 and 20 to shaft 12 (see FIG. 2). However, it is to be understood that screws 36, 38 and 40 (the fourth screw not shown) are configured in a manner such that that hooks 14, 16, 18 and 20 are secured to shaft 12 but are free to pivot with respect to shaft 12. Hooks 14, 16, 18 and 20 are discussed in detail below. Although the foregoing and ensuing discussions are in terms of retractable grappling hook 10 of the present invention using four hooks 4, 16, 18 and 20, it is to be understood that grappling hook 10 can be configured to use more or less than four hooks. For example, grappling hook 10 can be configured to use eight hooks. Such a configuration would utilize hook support member 31 shown in FIG. 8. Hook support member 31 includes central opening 33 for receiving shaft 12 and threaded inlets 35 for receiving screws that secure the hooks to support member 31.

Referring to FIGS. 2, 3, 4, 4A, 7, and 7A, hook control member (or force plate) 22 has side 22*a* and side 22*b* (see FIG. 2). Side 22*b* has detents or cavities 23*a*, 23*b*, 25*a*, 25*b* formed therein. In a preferred embodiment, detents 23*a* and

25*a* are about 60° apart. Similarly, detents 23*b* and 25*b* are preferably about 60° apart. Detents 23*a* and 23*b* are substantially diametrically positioned, i.e. 180° apart. Similarly, detents 25*a* and 25*b* are substantially diametrically positioned, i.e. 180° apart. The purpose of detents or cavities 23*a*, 23*b*, 25*a*, 25*b* will be discussed below in detail. Hook control member 22 further includes central opening 41 and openings 42, 44, 46 and 48. Central opening 41 is sized for receiving shaft 12. Hook control member 22 is rotatable about shaft 12 and can also move axially upon shaft 12. In a preferred embodiment, openings 42, 44, 46 and 48 are equidistantly spaced apart. In one embodiment, hook control member 22 has a substantially circular shape. However, hook control member 22 may be configured to have other geometric shapes. The purpose of hook control member 22 is discussed in detail below.

Figure 5:
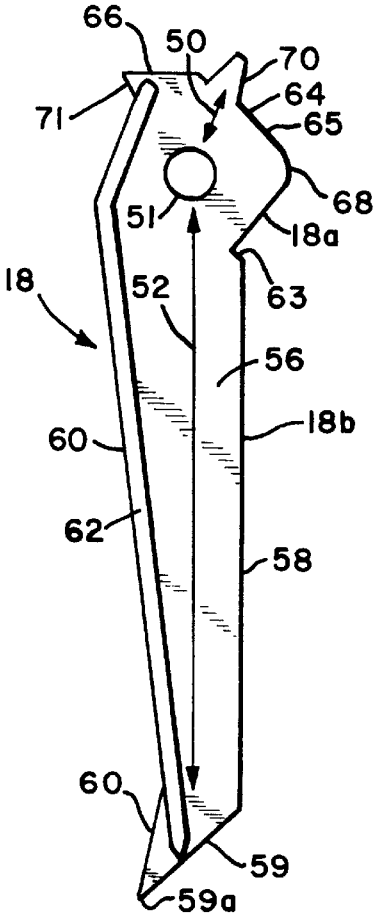
FIG. 5 is an elevational view of a hook depicted in FIG. 2.

Although the ensuing description is in terms of hook 18, it is to be understood that the description is also applicable to hooks 14, 16 and 20. Referring to FIG. 5, hook 18 comprises head portion 18*a* and elongate portion 18*b*. Head portion 18*a* has an axis 50 and an opening 51. Elongate portion 18*b* has longitudinally extending axis 52. Axis 50 is angulated with respect to axis 52. When grappling hook 10 is in the retracted position, the longitudinally extending axis 52 is substantially parallel to the longitudinally extending axis of shaft 12. When grappling hook 10 is in the extended position, the longitudinally extending axis 52 is angulated with respect to the longitudinally extending axis of shaft 12.

Referring to FIG. 5, hook 18 further includes planar surface 56, lengthwise end 58, lengthwise end 60 and longitudinally extending rib or lip 62. Lip 62 extends upward from planar surface 56 and is adjacent lengthwise end 60. Lip 62 extends for substantially the entire length of hook 18 and provides structural integrity. Hook 18 has a stepped portion 63 formed in lengthwise end 58. The purpose of portion 63 is discussed in detail below. Hook 18 further includes distal end 59. Distal end 59 and lengthwise end 60 converge to form hook point 59*a*. In a preferred embodiment, hook point 59*a* is very sharp so as to facilitate penetration of hard ground or soil.

Figure 4:
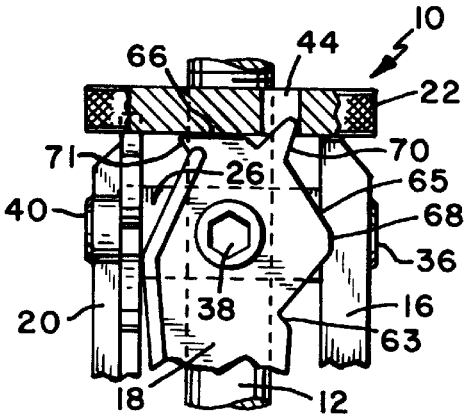
FIG. 4 is a view taken along line 4—4 of FIG. 3.
Figure 4A:
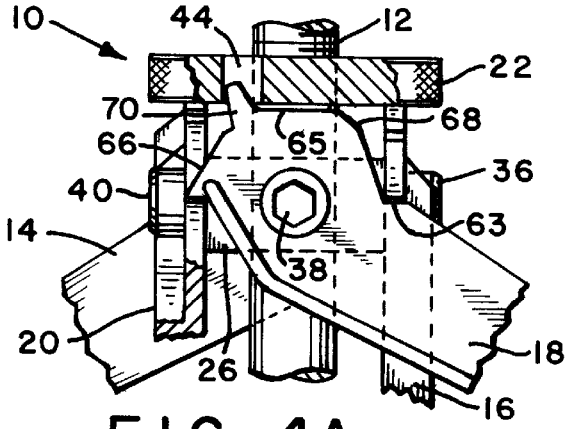
FIG. 4A is a view similar to FIG. 4 illustrating the movement of the hooks depicted in FIG. 1.

Referring to FIGS. 4, 4A and 5, head portion 18*a* has perimetrical edge 64 that comprises substantially flat or straight portions 65, 66 and rounded portion 68. Head portion 18*a* further includes protrusion 70 that extends from perimetrical edge 64 and is located between flat or straight portions 65 and 66. Flat portion 66 of perimetrical edge 64 is contiguous with edge 71. Edge 71 is sized for contacting the stepped portion (the same as stepped portion 63) of hook 20. Thus, each hook has an edge (the same as edge 71) that contacts the stepped portion (the same as stepped portion 63) of a successive hook when hooks 14, 16, 18 and 20 are in the extended position as shown in FIG. 9. Such a configuration effects interlocking of hooks 14, 16, 18 and 20 when the hooks are in the extended position. This feature is further discussed below. Referring to FIGS. 2, 3, 4, 4A and 9, each opening 42, 44, 46 and 48 of hook control member 22 is sized to receive a protrusion (e.g. protrusion 70) of a corresponding hook. Thus, for example, opening 44 receives protrusion 70 of hook 18.

Figure 6:
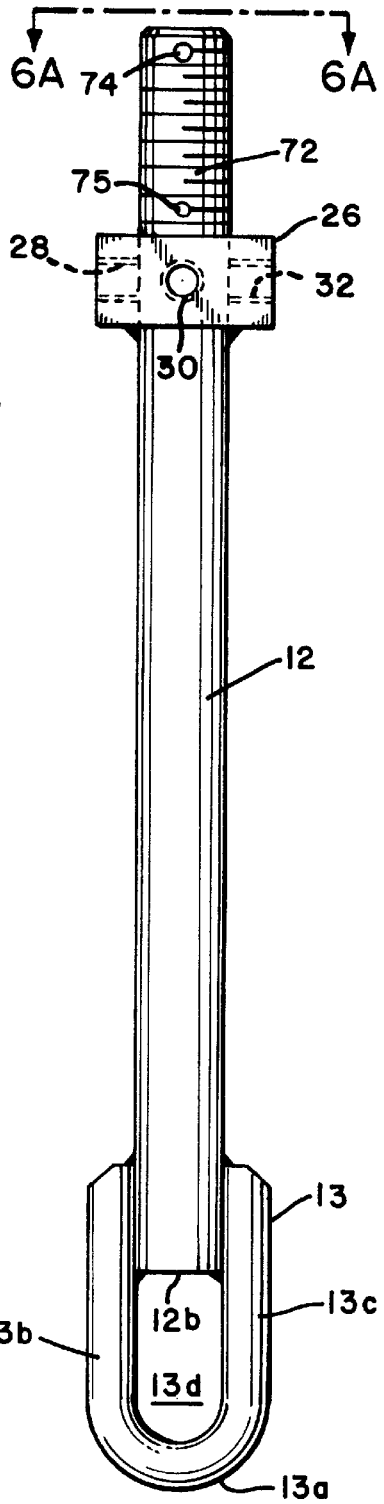
FIG. 6 is an elevational view of a shaft depicted in FIG. 2.
Figure 6A:
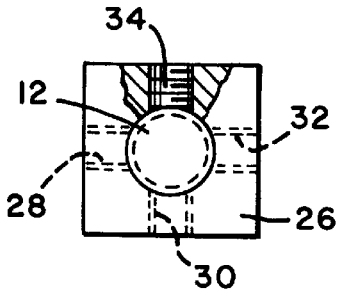
FIG. 6A is a view taken along line 6A—6A of FIG. 6.
Figure 8:
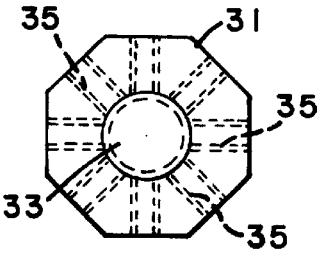
FIG. 8 is a top plan view of an alternate embodiment of a hook support member depicted in FIGS. 6 and 6A.

Referring to FIGS. 2, 6 and 9, shaft 12 further includes threaded portion 72 and bores or openings 74 and 75. In one embodiment, lock member 24 comprises a wing nut (hereinafter referred to as "wing nut 24"). However, it is to be understood that other configurations of lock member 24 can be used. Wing nut 24 is threadedly engaged to threaded portion 72 of shaft 12. Pin 76 is secured within bore 74 and protrudes from bore 74 so as to prevent the wing nut 24 from becoming dismounted from threaded portion 72. The purpose of this configuration will be discussed below. In one embodiment, pin 76 is frictionally inserted into bore 74. In another embodiment, bore 74 is threaded and a screw (e.g. allen-type screw) is used in place of pin 76. Wing nut 24 is rotatable in a clockwise or counter-clockwise direction. Bore 75 is positioned below bore 74 and is sized for receiving a pin (not shown) that protrudes from both openings of bore 75. The portions of the pin that protrude from the openings of bore 75 are sized for insertion into detents 23*a–b* and 25*a–b* located on side 22*b* of hook control member 22 (see FIG. 7A).

As shown in FIGS. 2 and 9, hook control member 22 is positioned between hooks 14, 16, 18, 20 and wing nut 24. Bore 74 is positioned at a predetermined location in shaft 12 so as to allow wing nut 24 to move a predetermined distance X to and from surface 22*a* of hook control member 22. When grappling hook 10 is vertically oriented as shown in FIG. 2 and wing nut 24 is rotated clockwise until it contacts surface 22*a* of hook control member 22, hook control member 22 is prevented from moving axially on shaft 12. When grappling hook 10 is vertically oriented as shown in FIG. 2 and wing nut 24 is rotated counter-clockwise so it is released from the surface 22*a* of hook control member 22, hook control member 22 is able to move axially on shaft 12.

Referring to FIGS. 1 and 9, in order to configure retractable grappling hook 10 of the present invention to the extended position, the user rotates wing nut 24 in the counter-clockwise direction until it contacts pin 76. The user then moves hook control member 22 axially along shaft 12 in a direction that is away from hooks 14, 16, 18 and 20. The distance hook control member 22 can move is designated as distance X in FIGS. 2 and 9. Next, the user rotates hook control member 22 in the clockwise direction in order to pivot hooks 14, 16, 18 and 20 to the extended position as shown in FIG. 9. Once the hooks 14, 16, 18 and 20 are in the extended position, the user then pivotally adjusts hook control member 22 so that the portions of the pin protruding from bore 75 slip into one of the pairs of diametrically positioned detents 23*a–b* or 25*a–b* to prevent further pivotal movement of hook control member 22 and to maintain hooks 14, 16, 18 and 20 in the extended position. The user then rotates wing nut 24 in the clockwise direction until it contacts surface 22*a* of hook control member 22 so as to prevent axial movement of hook control member 22 and to lock grappling hook 10 in the extended position (see FIG. 9). When grappling hook 10 is locked in the extended position, hooks 14, 16, 18 and 20 are interlocked with one another, as discussed above, thereby forming a load resisting network that supports each hook. Additionally, when grappling hook 10 is locked in the extended position, flat surface 65 of hook 18 (as well as hooks 14, 16 and 20) contacts side 22*b* of hook control member 22 so as to transfer the load to hook control member 22 thereby reducing the force and pressure on protrusion 70 (as well as the protrusions of hooks 14, 16 and 20). When grappling hook 10 is in the extended position, the longitudinally extending axis of each hook 14, 16, 18 and 20 is angulated with respect to the axis of shaft 12.

Referring to FIG. 2, in order to configure retractable grappling hook 10 of the present invention to the retracted position, the user rotates wing nut 24 in the counter-clockwise direction until it contacts pin 76. The user then moves hook control member 22 axially along shaft 12 in a direction that is away from hooks 14, 16, 18 and 20 in order to disengage the pin protruding from the bore 75 from the detent formed in side 22*b* of hook control member 22. Next, the user rotates hook control member 22 in the counter-clockwise direction in order to pivot hooks 14, 16, 18 and 20 to the retracted position shown in FIG. 2. Once the hooks 14, 16, 18 and 20 are in the retracted position, the user then pivotally adjusts hook control member 22 so that the portions of the pin protruding from bore 75 slip into the other one of the pairs of diametrically positioned detents 23*a–b* or 25*a–b* to prevent further pivotal movement of hook control member 22 and to maintain hooks 14, 16, 18 and 20 in the retracted position. The user then rotates wing nut 24 in the clockwise direction until it contacts surface 22*a* of hook control member 22 so as to prevent axial movement of hook control member 22 and lock grappling hook 10 in the retracted position as shown in FIG. 2. When grappling hook 10 is in the retracted position, flat surface 66 of hook 18 (as well as hooks 14, 16 and 20) contacts side 22*b* of hook control member 22 in order to stabilize and prevent movement of hooks 14, 16, 18 and 20. Additionally, when grappling hook 10 is in the retracted position, the longitudinally extending axis of each hook 14, 16, 18 and 20 is substantially parallel to the axis of shaft 12.

Although the foregoing discussion is in terms of retractable grappling hook 10 of the present invention using four hooks 14, 16, 18, and 20, it is to be understood that grappling hook 10 may be modified to use more or less than four hooks. To implement such configurations, the size of hook control member 22 and the number of openings (i.e. 42, 44, 46 and 48) are varied to accommodate the actual number of hooks. Furthermore, the construction of hook support member 26 would be modified to that shown in FIG. 8 or another suitable configuration.

In a preferred embodiment, grappling hook 10 of the present invention is fabricated from high-strength metals or alloys such as iron, steel, stainless steel, titanium. In a most preferred embodiment, the metal is corrosion-resistant.

The retractable grappling hook 10 of the present invention can be used for recreational purposes, e.g. hiking, mountain climbing, etc. It can also be used for maritime purposes, e.g. boat anchor, buoy anchors, etc. Furthermore, retractable grappling hook 10 is suited for military applications due to its (i) relatively light weight, (ii) simple construction, and (iii) compactness. Such military applications include:

a) use by personnel in scaling obstacles, mountains, buildings, etc.

b) use with rescue lines, cables or wires;

c) clearing mine fields d) detecting trip wires;

e) detecting tilt-rod type detonators;

f) anchoring a rappel rope, rescue line or climbing rope when a "tie-off" method cannot be used;

g) use with vehicle mounted winches for extricating vehicles from ditches or mud or for assisting vehicles in ascending steep terrain; and h) use with launching equipment such as mortars, guns, shoulder carried launching equipment, etc.

Thus, retractable grappling hook 10 of the present invention:

a) is easy and convenient to use;

b) can be used for recreational, maritime and military applications;

c) is comprised of individual components that can easily be replaced;

d) is compact and easy to transport and store;

e) is relatively lightweight;

f) can be fabricated from available materials;

g) can be configured in a variety of sizes that utilize varying numbers of hooks; and h) can be manufactured at a reasonable costs.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A retractable grappling hook, comprising:

a shaft having a longitudinal extending axis;

a plurality of hooks pivotally attached to the shaft, each hook having a longitudinally extending axis and being pivotal to a retracted position such that the axis of each hook is substantially parallel to the axis of the shaft and to an extended position such that the axis of each hook is angulated with respect to the axis of the shaft;

a hook control system on the shaft for configuring and locking the hooks in either the extended or retracted positions; and an attachment member attached to the shaft; wherein said hook control system comprises a hook control member movably attached to the shaft for pivoting the hooks to either the extended or retracted position, and a lock member movable attached to the shaft for preventing movement of the hook control member so as to lock the hooks in either the extended or retracted positions; wherein each hook has a protruding region thereon wherein the hook control member comprises a plate member having a central opening for receiving the shaft and a plurality of engagement regions, each of the engagement regions engaging a protruding region of a corresponding hook, the plate member being rotatable and axially movable upon the shaft, the hooks being configured in the extended position when the plate member is rotated in a first direction and in the retracted position when the plate member is rotated in a second direction; and wherein the engagement regions of the plate member comprise a plurality of openings surrounding the central opening, each opening being sized for receiving a protruding region of a corresponding hook.

2. The retractable grappling hook according to claim 1 wherein the shaft includes a threaded portion, the lock member comprising a wing nut threadedly engaged to the threaded portion of the shaft, the wing nut being rotatable to a first orientation and to a second orientation, when the wing nut is rotated to the first orientation, the plate member is prevented from axial movement upon the shaft, when the wing nut is rotated to the second orientation, the plate member is axially movable upon the shaft.

3. The retractable grappling hook according to claim 2 wherein the plate member has a first side for contacting the wing nut and a second side facing the hooks, the second side of the plate member having a first detent and a second detent, the shaft having a protrusion attached thereto which is sized for insertion into either of the first or second detents, the shaft protrusion being disposed within the first detent when the plate member is rotated in the first direction to extend the hooks and within the second detent when the plate member is rotated in the second direction to retract the hooks.

4. The retractable grappling hook according to claim 2 wherein each hook has an opening, the retractable grappling hook further comprising:

a hook support member attached to the shaft, the hook support member having a plurality of threaded openings, each opening corresponding to one of the plurality of hooks; and a plurality of screws, each screw disposed through an opening of one of the hooks and threadedly engaged with a corresponding opening of the hook support member.

5. The retractable grappling hook according to claim 1 wherein the openings surrounding the central opening are equidistantly spaced apart.

6. The retractable grappling hook according to claim 1 wherein the plurality of hooks comprises four hooks, the axes of the hooks being equidistantly spaced apart when the hooks are in the retracted position and the extended position.

7. The retractable grappling hook according to claim 1 wherein the shaft has a first end and a second end, the hook control system being on a portion of the shaft in proximity to the first end of the shaft.

8. The retractable grappling hook according to claim 7 wherein the attachment member is attached to the second end of the shaft, the attachment member being substantially U-shaped and having a closed end and a pair of extending wall members which define an interior region, the second end of the shaft being disposed within a portion of the interior region, a remaining portion of the interior region defining an opening.

9. The retractable grappling hook according to claim 1 wherein each hook has an outer substantially planar surface and an inner substantially planar surface facing the shaft when the retractable grappling hook is in a retracted state, each hook further including a first lengthwise end, a second lengthwise end opposite the first lengthwise end and a distal end.

10. The retractable grappling hook according to claim 9 wherein each hook further comprises a longitudinally extending rib extending upwardly from the outer planar surface adjacent the first lengthwise end.

11. The retractable grappling hook according to claim 1 wherein a first lengthwise end of a hook and a distal end of a hook coverage to form a point.

12. The retractable grappling hook according to claim 1 wherein each hook has an engagement portion extending from a first lengthwise end and an engagement region formed in a second lengthwise end, the engagement portion of each hook engaging the engagement region of another hook when the hooks are in the extended position so as to interlock the hooks.

13. The retractable grappling hook according to claim 1 wherein each hook has a head portion and an elongate portion attached to the head portion, the protruding region being on the head portion.

14. The retractable grappling hook according to claim 13 wherein the head portion and elongate portion each has an axis, the axis of the head portion being angulated with respect to the axis of a body portion.

15. The retractable grappling hook according to claim 14 wherein the head portion has a perimetrical edge, the protruding region comprising a protrusion extending from the perimetrical edge, the perimetrical edge comprising a substantially straight portion and a rounded portion, the protrusion being intermediate the straight and rounded portions.

16. The retractable grappling hook according to claim 1 wherein the shaft, hooks, hook control system and attachment member are fabricated from metal.

* * * * *